US008235431B2

(12) United States Patent
Williamson

(10) Patent No.: US 8,235,431 B2
(45) Date of Patent: Aug. 7, 2012

(54) DOOR FURNITURE MOUNTING ASSEMBLY

(75) Inventor: Geoff Williamson, Ferntree Gully (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 268 days.

(21) Appl. No.: 12/435,739

(22) Filed: May 5, 2009

(65) Prior Publication Data

US 2010/0019516 A1 Jan. 28, 2010

(30) Foreign Application Priority Data

Jul. 24, 2008 (AU) ..... 2008903791

(51) Int. Cl.
*E05B 15/02* (2006.01)
*E05B 3/00* (2006.01)

(52) U.S. Cl. ..... 292/357; 292/348; 292/DIG. 53; 292/DIG. 54

(58) Field of Classification Search ..... 292/348, 292/349, 350, 357, 347, 351, 355, 356, DIG. 2, 292/DIG. 27, DIG. 53, DIG. 54, DIG. 60
See application file for complete search history.

(56) References Cited

U.S. PATENT DOCUMENTS

| | | | | |
|---|---|---|---|---|
| 2,297,077 | A * | 9/1942 | Schlage | 292/337 |
| 2,423,206 | A * | 7/1947 | Schlage | 292/357 |
| 2,454,754 | A * | 11/1948 | Netschert | 292/359 |
| 2,947,507 | A * | 8/1960 | Schlage et al. | 248/206.5 |
| 4,789,191 | A * | 12/1988 | Dennis | 292/347 |
| 4,869,083 | A * | 9/1989 | DeMarseilles et al. | 70/224 |
| 5,123,682 | A * | 6/1992 | Robida et al. | 292/169 |
| 5,125,696 | A * | 6/1992 | Robida et al. | 292/169.16 |
| 5,566,996 | A | 10/1996 | Massey et al. | |
| 5,732,578 | A * | 3/1998 | Kang | 70/224 |
| 6,264,255 | B1 * | 7/2001 | Fortune | 292/336.3 |
| 6,616,203 | B1 * | 9/2003 | Lenk et al. | 292/336.3 |
| 7,066,507 | B2 * | 6/2006 | Don | 292/336.3 |
| 2008/0067820 | A1 | 3/2008 | Huang et al. | |
| 2008/0116699 | A1 * | 5/2008 | Karcher et al. | 292/336.3 |

FOREIGN PATENT DOCUMENTS

| | | | |
|---|---|---|---|
| EP | 0 884 435 | A1 | 12/1998 |
| FR | 2650322 | A1 | 2/1991 |

OTHER PUBLICATIONS

Examiner's First Report dated Dec. 17, 2010, issued in Australian Application No. 200920703, 2 pages.

* cited by examiner

*Primary Examiner* — Carlos Lugo
*Assistant Examiner* — Alyson M Merlino
(74) *Attorney, Agent, or Firm* — Kilpatrick Townsend & Stockton LLP

(57) ABSTRACT

A door furniture mounting assembly (10, 10') including a relatively smaller rosette (12) with a handle side and a door side. The door side of the rosette (12) includes at least one exterior recess (24) adapted for rotational and axial engagement with at least one inwardly extending protuberance (32) on the door side of a relatively larger rosette sleeve (30).

21 Claims, 3 Drawing Sheets

DOOR FURNITURE MOUNTING ASSEMBLY

CROSS-REFERENCE TO RELATED APPLICATION

This application claims priority to Australian Application No. 2008903791, filed Jul. 24, 2008, the disclosure of which is incorporated herein by reference.

FIELD OF THE INVENTION

The present invention relates to a door furniture mounting assembly for latch sets and knob sets.

BACKGROUND OF THE INVENTION

The door furniture of many latch sets and knob sets includes a round rosette with a handle or knob extending therefrom. The rosettes are commonly produced with outer diameters of approximately 55 mm and 65 mm. The two different sizes are available as some customers prefer 55 mm rosettes over 65 mm and vice versa for visual or aesthetic reasons.

Many doors are supplied with a 54 mm door furniture hole pre-drilled therein, in order to receive the cylindrical latch bodies of assemblies with 65 mm rosettes. In contrast, an assembly with a 55 mm rosette requires a 35 mm diameter hole, for receiving the latch body, and a pair of smaller, diametrically opposed, holes for receiving the rosette's mounting posts. If an assembly with a 55 mm rosette is used with a door with a 54 mm pre-drilled hole, it can fail by falling into the hole.

As a result of the above, door furniture manufacturers must, disadvantageously, maintain two inventories of componentry able to suit either assemblies with 55 mm or 65 mm rosettes respectively.

OBJECT OF THE INVENTION

It is the object of the present invention to substantially overcome or at least ameliorate the above disadvantage.

SUMMARY OF THE INVENTION

Accordingly, in a first aspect, the present invention provides a door furniture mounting assembly including:

a relatively smaller rosette with a handle side and a door side, the door side of the rosette including at least one exterior recess adapted for rotational and axial engagement with at least one inwardly extending protuberance on the door side of a relatively larger rosette sleeve.

In a second aspect, the present invention provides a door furniture mounting assembly including:

a relatively smaller rosette with a handle side and a door side, the door side of the first inner rosette part including at least one exterior recess; and a relatively larger rosette sleeve having at least one inwardly extending protuberance adapted to rotationally and axially engage with the at least one recess(es).

The rosette preferably includes 3 equiangularly spaced apart recesses. The rosette sleeve preferably includes 3 equiangularly spaced apart protuberances.

The recess(es) preferably extend from the door side through about half of the axial dimension of the rosette. The protuberance(s) preferably extend from the door side through about half of the axial dimension of the rosette sleeve.

The rosette is preferably adapted for mounting of a handle or knob thereto.

The rosette includes an engagement means, preferably an O-ring in a groove, adapted for an interference fit engagement with a relatively smaller decorative cap. The O-ring and groove are preferably on the handle side of the rosette.

The rosette sleeve includes an engagement means, preferably an O-ring in a groove, adapted for an interference fit engagement with a relatively larger decorative cap. The O-ring and groove are preferably on the handle side of the rosette sleeve.

The rosette is preferably substantially cylindrical. The rosette sleeve is preferably substantially cylindrical, and has an inner diameter that is slightly larger than the outer diameter of the rosette.

The rosette preferably includes a notch adapted to allow a privacy snib actuator therethrough. The rosette sleeve preferably includes a notch adapted to allow a privacy snib actuator therethrough. The relatively smaller decorative cap preferably includes a notch adapted to allow a privacy snib actuator therethrough. The relatively larger decorative cap preferably includes a notch adapted to allow a privacy snib therethrough.

In use, the rosette sleeve is preferably secured to the door by being sandwiched between the door and the rosette.

The axial thickness of the rosette and the rosette sleeve are preferably approximately equal. The axial thickness of the smaller decorative cap and the larger decorative cap are preferably approximately equal.

BRIEF DESCRIPTION OF THE DRAWINGS

A preferred embodiment of the present invention will now be described, by way of an example only, with reference to the accompanying drawings in which.

DETAILED DESCRIPTION OF THE PREFERRED EMBODIMENT

Figure 1:
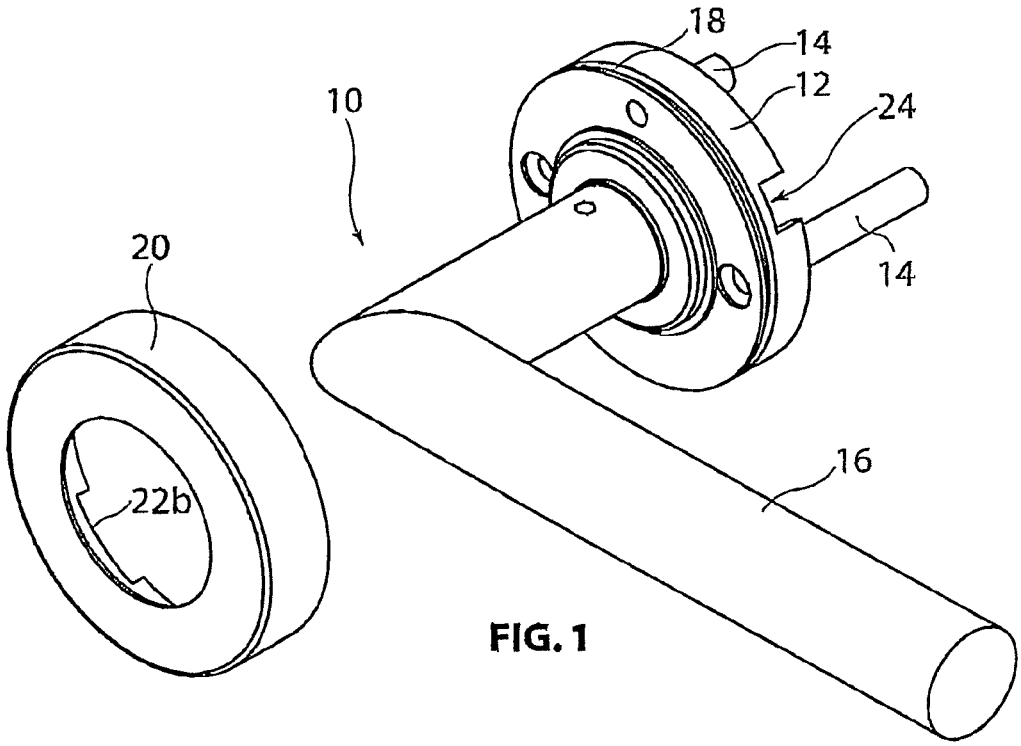
FIG. 1 is an exploded front perspective view of an embodiment of a door furniture mounting assembly configured for use with a 55 mm rosette.
Figure 2:
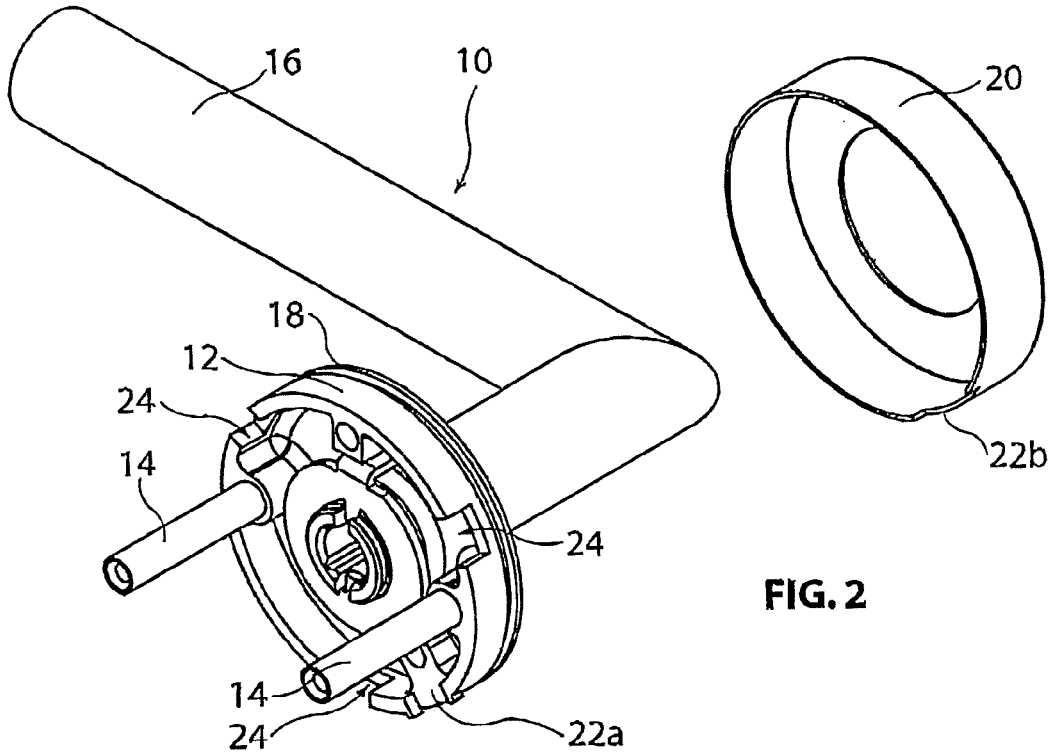
FIG. 2 is a rear exploded perspective view of the assembly shown in FIG. 1.

FIGS. 1 and 2 show an embodiment of a door furniture mounting assembly 10 configured for use with a 55 mm rosette. The assembly 10 includes a (relatively smaller) generally cylindrical rosette 12 having a pair of mounting posts 14 mounted thereto. The rosette 12 also has a spring-return lever handle 16 mounted thereto. The handle side of the rosette 12 includes an O-ring 18 within a groove adapted for an interference fit engagement with a decorative cap 20. The rosette 10 and the cap 20 each includes a notch 22*a* and 22*b* respectively to allow the actuator of a privacy snib (not shown) to pass therethrough.

The above features of the assembly 10 are conventional and suitable for mounting to a door with an approximately 35 mm diameter hole in the conventional manner. The assembly 10 is installed on one side of a door and usually connected to a similar assembly mounted on the opposite side of the door, as is also conventional.

However, as shown in FIGS. 1 and 2, the door side of the rosette 12 also includes three equiangularly spaced-apart exterior recesses 24, the purpose of which will be described in more detail below. The recesses 24 extend through about half the axial thickness of the rosette 12.

Figure 3:
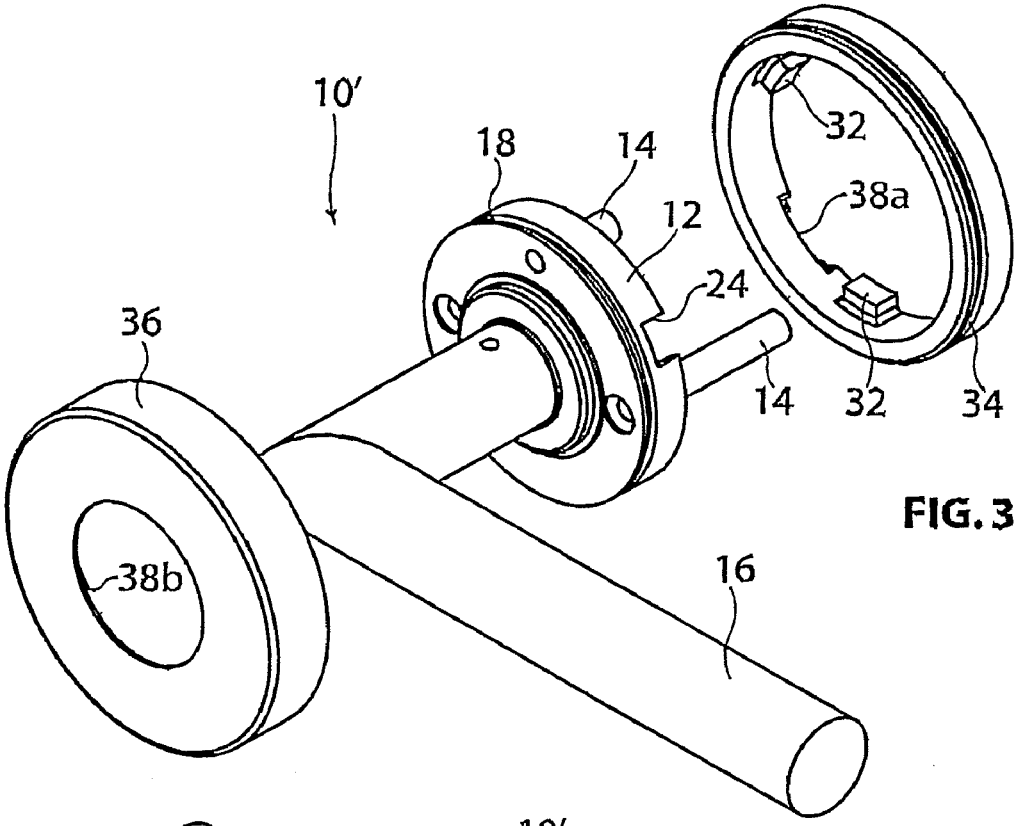
FIG. 3 is a front exploded perspective view of the assembly shown in FIG. 1 configured for use with a 65 mm rosette.
Figure 4:
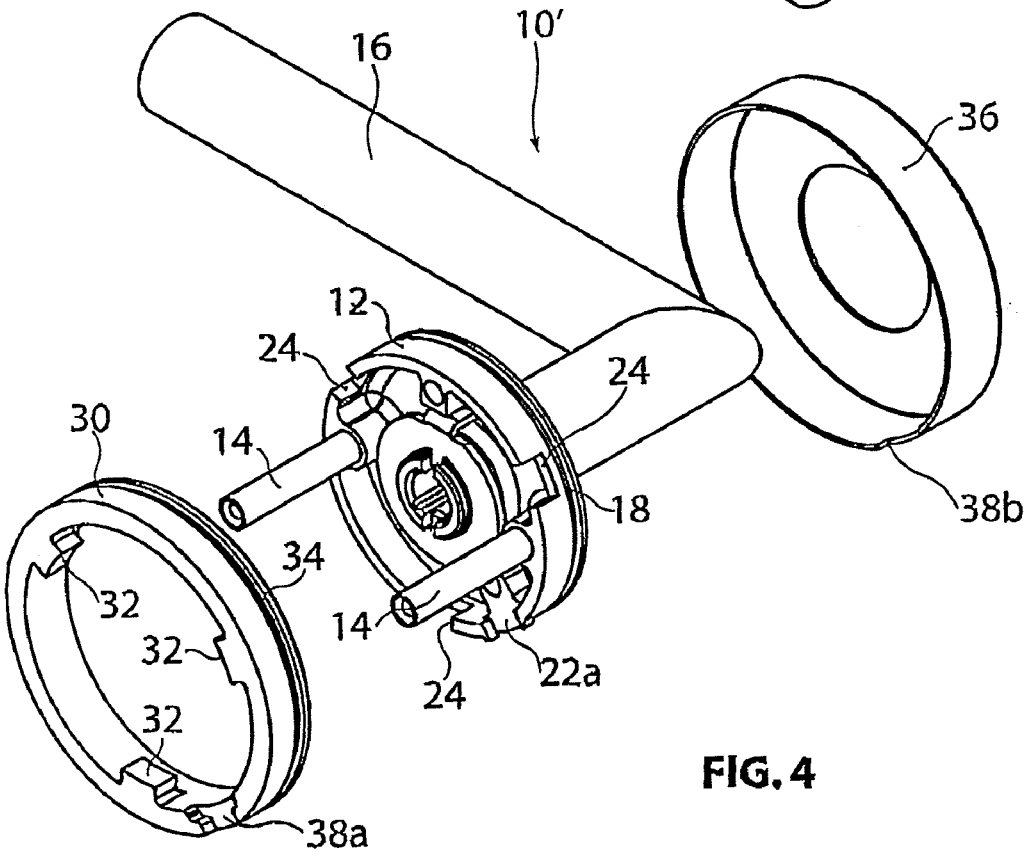
FIG. 4 is a rear perspective view of the assembly shown in FIG. 3.

FIGS. 3 and 4 show a reconfigured assembly 10', similar to that shown in FIGS. 1 and 2, with the exclusion of the decorative cap 20, and the inclusion of (relatively larger) rosette sleeve 30. The rosette sleeve 30 has three of equiangularly spaced-apart inwardly projecting protuberances 32. The rosette sleeve 30 also includes an O-ring 34 within a groove, for an interference fit engagement with a 65 mm outer diameter decorative cap 36. The rosette sleeve 30 and the cap 36 also each include a notch 38*a* and 38*b* respectively for the, previously mentioned, actuator of a privacy snib (not shown) to pass therethrough.

The protuberances 32 of the rosette part 30 engage with the recesses 24 and serve to locate the rosette part 30 both rotationally and axially in relation to the rosette 12. This engagement has several effects.

Firstly, the diameter of the assembly 10' overall is increased so as to suit threaded engagement with the 65 mm diameter decorative cap 36. The engagement between the protuberances 32 and the recesses 24 prevents the rosette sleeve 30 from rotating relative to the rosette 12.

Secondly, the rosette sleeve 30 increases the rosette's diameter and makes it suitable for installation over a (pre-drilled) 54 mm diameter hole without risk of the assembly 10' falling into a hole of that size.

Figure 5A:
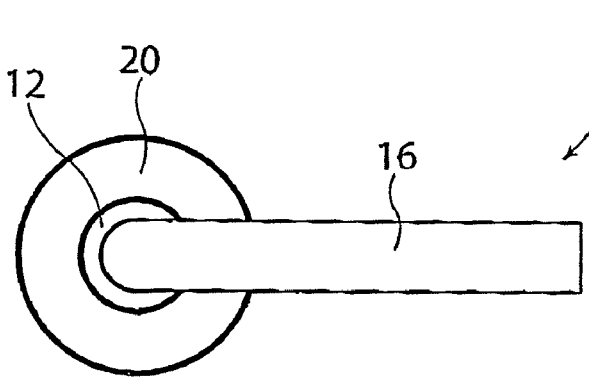
FIG. 5*a* is an assembled front view of the assembly shown in FIG. 1.
Figure 5B:
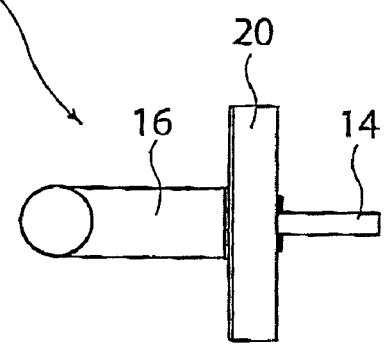
FIG. 5*b* is an assembled side view of the assembly shown in FIG. 1.
Figure 6A:
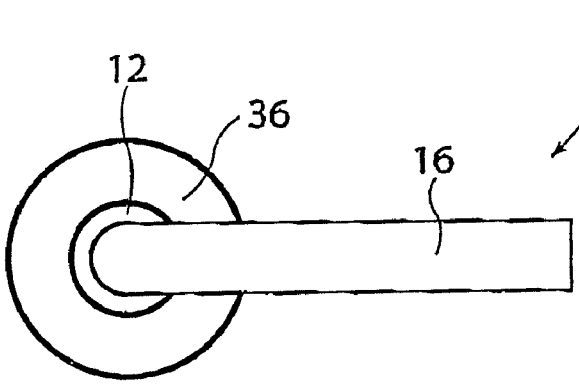
FIG. 6*a* is an assembled front view of the assembly shown in FIG. 3.
Figure 6B:
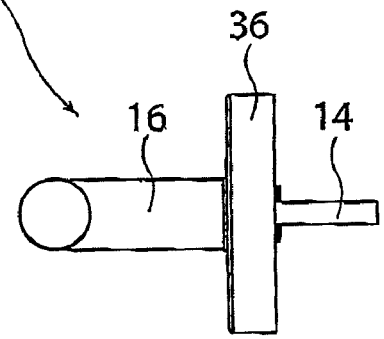
FIG. 6*b* is an assembled side view of the assembly shown in FIG. 3.

FIGS. 5*a* and 5*b* show the assembly 10 configured for use with a 55 mm diameter rosette. FIGS. 6*a* and 6*b* show the assembly 10' configured with the rosette sleeve 30 for use with a 65 mm diameter rosette. As is evident from FIGS. 6*a* and 6*b*, the increase in the diameter of the rosette 36 is achieved without causing any increase in thickness of the overall assembly 10 compared to the overall assembly 10'.

The assemblies 10, 10' have several advantages. Firstly, they allow door furniture manufacturer to greatly reduce their inventory by providing door furniture mounting assemblies with 55 mm and 65 mm rosettes that share the majority of their parts. Secondly, this shared componentry can be easily and quickly reconfigured from 55 mm rosette use to 65 mm rosette use by the addition of two relatively minor components (the rosette part 30 and the decorative cap 36). Thirdly, when configured as a 65 mm rosette, the assembly 10' requires very little in the way of additional installation steps as the rosette sleeve 30 is secured by being sandwiched between the door and the rosette 12.

Although the invention has been described with reference to a preferred embodiment, it will be appreciated by persons skilled in the art that the invention may be embodied in many other forms. For example, in another embodiment (not shown), one of the three recesses/protuberances is larger than the other two to ensure that rosette and the rosette sleeve are always assembled with their respective privacy snib actuator notches in alignment.

The invention claimed is:

1. A door furniture mounting assembly for mounting of a handle or knob set to doors having mounting holes of differing sizes, the assembly including:

a substantially cylindrical rosette, having a first external diameter, with a handle side and a door side, the door side of the rosette including at least one exterior recess adapted for rotational and axial engagement with at least one inwardly extending protuberance on a door side of a substantially cylindrical rosette sleeve, having a second external diameter larger than the first external diameter, the at least one exterior recess and at least one inwardly extending protuberance being concealed by the rosette sleeve when so engaged with the rosette, wherein the rosette includes an engagement means adapted for an interference fit engagement with a first decorative cap.

2. The door furniture assembly as claimed in claim 1, wherein the at least one exterior recess of the rosette includes 3 equiangularly spaced apart recesses.

3. The door furniture assembly as claimed in claim 2, wherein the at least one inwardly extending protuberance of the rosette sleeve includes 3 equiangularly spaced apart protuberances.

4. The door furniture assembly as claimed in claim 1, wherein the at least one exterior recess extends from the door side through about half of the axial dimension of the rosette.

5. The door furniture assembly as claimed in claim 4, wherein the at least one inwardly extending protuberance extends from the door side through about half of the axial dimension of the rosette sleeve.

6. The door furniture assembly as claimed in claim 1, wherein the rosette is adapted for mounting of a handle or knob thereto.

7. The door furniture assembly as claimed in claim 1, wherein the rosette sleeve includes an engagement means adapted for an interference fit engagement with a second decorative cap, the second decorative cap being larger than the first decorative cap.

8. The door furniture assembly as claimed in claim 1, wherein the rosette includes a notch adapted to allow a privacy snib actuator to be received therethrough.

9. The door furniture assembly as claimed in claim 1, wherein, in use, the rosette sleeve is secured to the door by the at least one inwardly extending protuberance being sandwiched between the door and the rosette within the at least one exterior recess.

10. A door furniture mounting assembly for mounting of a handle or knob set to doors having mounting holes of differing sizes, the assembly including:

a substantially cylindrical rosette, having a first external diameter, with a handle side and a door side, the door side of the rosette including at least one exterior recess, wherein the rosette includes an engagement means adapted for an interference fit engagement with a first decorative cap; and a substantially cylindrical rosette sleeve, having a second external diameter larger than the first external diameter, including at least one inwardly extending protuberance adapted to rotationally and axially engage with the at least one exterior recess, the at least one exterior recess and the at least one inwardly extending protuberance being concealed by the rosette sleeve when so engaged with the rosette.

11. The door furniture assembly as claimed in claim 10, wherein the at least one exterior recess of the rosette includes 3 equiangularly spaced apart recesses.

12. The door furniture assembly as claimed in claim 11, wherein the at least one inwardly extending protuberance of the rosette sleeve includes 3 equiangularly spaced apart protuberances.

13. The door furniture assembly as claimed in claim 10, wherein the at least one exterior recess extends from the door side through about half of the axial dimension of the rosette.

14. The door furniture assembly as claimed in claim 13, wherein the at least one inwardly extending protuberance extends from the door side through about half of the axial dimension of the rosette sleeve.

15. The door furniture assembly as claimed in claim 10, wherein the rosette is adapted for mounting of a handle or knob thereto.

16. The door furniture assembly as claimed in claim 10, wherein the rosette sleeve includes an engagement means adapted for an interference fit engagement with a second decorative cap, the second decorative cap being larger than the first decorative cap.

17. The door furniture assembly as claimed in claim 10, wherein the rosette includes a notch adapted to allow a privacy snib actuator to be received therethrough.

18. The door furniture assembly as claimed in claim 17, wherein the rosette sleeve includes a notch adapted to allow the privacy snib actuator to be received therethrough.

19. The door furniture assembly as claimed in claim 18, wherein the first decorative cap includes a notch adapted to allow the privacy snib actuator to be received therethrough.

20. The door furniture assembly as claimed in claim 19, wherein the second decorative cap includes a notch adapted to allow the privacy snib actuator to be received therethrough.

21. The door furniture assembly as claimed in claim 10, wherein, in use, the rosette sleeve is secured to the door by the at least one inwardly extending protuberance being sandwiched between the door and the rosette within the at least one exterior recess.

* * * * *